US007789580B2

(12) United States Patent
Cheng

(10) Patent No.: US 7,789,580 B2
(45) Date of Patent: Sep. 7, 2010

(54) ERGONOMIC PEN WITH CONVEX DEVICE FOR INDEX FINGER EXERTING FORCE THEREON

(76) Inventor: Wen-Bing Cheng, No. 155, Jhongsing St., Taoyuan City 330 Taiwan (CN)

( * ) Notice: Subject to any disclaimer, the term of this patent is extended or adjusted under 35 U.S.C. 154(b) by 0 days.

(21) Appl. No.: 12/282,546

(22) PCT Filed: Apr. 26, 2006

(86) PCT No.: PCT/CN2006/000796

§ 371 (c)(1),
(2), (4) Date: Sep. 12, 2008

(87) PCT Pub. No.: WO2007/121613

PCT Pub. Date: Nov. 1, 2007

(65) Prior Publication Data

US 2009/0060621 A1 Mar. 5, 2009

(51) Int. Cl.
*A46B 5/02* (2006.01)

(52) U.S. Cl. ..... 401/6; 401/7

(58) Field of Classification Search ..... 401/6, 401/7, 131; 16/430

See application file for complete search history.

(56) References Cited

U.S. PATENT DOCUMENTS 1,160,832 A * 11/1915 Borsella ..... 15/443
4,167,347 A * 9/1979 Hoyle ..... 401/88
4,526,547 A 7/1985 Rusk
4,832,604 A * 5/1989 Rusk ..... 434/166
5,143,463 A 9/1992 Pozil et al.
6,254,293 B1 7/2001 Citrenbaum
6,554,515 B2 4/2003 Debbas

FOREIGN PATENT DOCUMENTS

CN 2801498 Y 2/2006
JP 2001-1681 A 1/2001

* cited by examiner

*Primary Examiner*—David J Walczak

(57) ABSTRACT

An ergonomic pen having a convex device for an index finger exerting force thereon includes a first indentation proximate a tip thereof, a second indentation besides the first indentation, and an elongate member between the first and second indentations. The elongate member has a convex top surface. The first indentation is adapted to be urged by the muscle opposing the finger nail of the thumb, the second indentation is adapted to be urged by the muscle opposing the finger nail of the middle finger, and the elongate member is adapted to be urged by the muscle opposing the finger nail of the index finger, respectively, with the wrist being disposed in a relatively relaxed position in writing. Easy, labor saving writing can be effected.

5 Claims, 5 Drawing Sheets

ERGONOMIC PEN WITH CONVEX DEVICE FOR INDEX FINGER EXERTING FORCE THEREON

BACKGROUND OF THE INVENTION

1. Field of Invention

The invention relates to writing instruments and, more particularly, to an ergonomic pen having opposite first and second indentations and a convex device for an index finger exerting force thereon, all proximate the tip so that an individual may feel a degree of comfort in writing by urging the muscles opposing the finger nails of the thumb, the middle finger and the index finger against the first indentation, the second indentation, and the convex device respectively, with the wrist being disposed in a relatively relaxed position and in a labor saving manner.

2. Description of Related Art

A correct pen holding posture can save labor in writing. Typically an individual may think a correct pen holding posture means thumb, index finger, and middle finger are positioned in correct positions with other factors not being considered. Conventionally, an individual may hold a pen in a posture either shown in FIG. 5A or shown in FIG. 5B. It is seen that tip of middle finger is urged against the pen, thumb is in the front, and the index finger is urged by the thumb so that the pen can be held firmly. A great force is exerted by the thumb. Thus, the thumb may be fatigued easily. Also, the thumb is bent and may block the view. In turn, the individual has to incline the body, lower the head, and incline the head in order to clearly see what is being written. The pen is held firmly by the portion between thumb and index finger. Hence, a great force is exerted on the index finger. Thus, the thumb, index finger, and middle finger are restricted in movement. That is, the thumb, index finger and middle finger are only allowed to move in a limited range. As a result, all fingers may be deformed permanently after a long period of time of writing in such a posture. Further, the tip of the index finger may be hurt. It is understood that the hand muscle is not strong enough for preschool children. Hence, a child may have the thumb and index finger close to the tip of pen in writing. This posture is typically seen when writing small letters. However, it inevitably may block the view and cause the body to be posed in an unnatural position. As such, the neck, the shoulder, and the spine of a child may be hurt if writing is always done in such a posture. In turn, children may experience muscle soreness and other discomforts. Eventually, children may be afraid of writing.

People may have another misunderstanding about pen holding posture. In detail, people may think both the thumb and index finger are required to bend and exert a great force on a pen in order to hold the pen firmly in writing. However, this is a wrong pen holding posture with the wrist force not being considered. Also, the lever effect of the hand is not considered. As a result, writing is slow, the pen is not held in a substantially upright position, and involved fingers are restricted to move in a limited range. Hence, it is only appropriate to write small letters. Further, it is not an ergonomic pen holding posture. It is typical for an individual to bend the wrist inward when the thumb and index finger are involved in writing a word transversely. In turn, the pen is forced to incline forward. This has the disadvantage of causing the wrist to fatigue easily or even to be hurt. This is absolutely an incorrect pen holding posture in writing.

In short, typical postures are not correct, because they are unnatural positions with the palm not bent to form a space, too much force is exerted by the thumb, there is limited movement range of the fingers, the wrist is disposed in a tight position, and no or little force is exerted by the wrist in transverse writing. As a result, drawbacks including slow writing, difficult writing, unsightly writing, hand muscle soreness, fingers pain, eye fatigue, and body pain occur.

Children having the above writing drawbacks may have an adverse effect on his or her study. In detail, a child may not know how to hold a pen correctly. Hence, the child may think writing is difficult, time consuming, and boring work. To the worse, the child may hate writing. In addition, it may be difficult to correct such wrong pen holding posture when a child has grown as an adult. This definitely may have an adverse effect on the child.

Thus, a pen having a novel convex device for an index finger exerting force thereon has been invented. It is the hope that the pen with the convex device for an index finger exerting force thereon may solve the above problems associated with the conventional pen.

SUMMARY OF THE INVENTION

It is therefore one object of the invention to provide an ergonomic pen comprising a forward first indentation, a second indentation besides the first indentation, and an elongate member having a convex top between the first and second indentations. Thus, when the first indentation is urged by the muscle opposing the finger nail of the thumb, the second indentation is urged by the muscle opposing the finger nail of the middle finger, and the elongate member is urged by the muscle opposing the finger nail of the index finger, a labor saving writing will be effected.

It is another object of the invention to provide an ergonomic pen comprising a first indentation proximate a tip thereof; a second indentation besides the first indentation; and an elongate member between the first and second indentations, with the elongate member having a convex top surface. The first indentation is adapted to be urged by the muscle opposing the finger nail of the thumb, the second indentation is adapted to be urged by the muscle opposing the finger nail of the middle finger, and the elongate member is adapted to be urged by the muscle opposing the finger nail of the index finger respectively in writing.

In a first aspect of the invention, there are further provided a first sleeve including the first indentation, the second indentation, and the elongated member; and a cylindrical refill secured to the first sleeve by inserting through.

In a second aspect of the invention, there are further provided a second sleeve shorter than the first sleeve, the second sleeve including the first indentation, the second indentation, and the elongated member; and a cylindrical refill secured to the second sleeve by inserting through.

In a third aspect of the invention, the pen having a convex device for index finger exerting force thereon can cause the thumb, the index finger, and the middle finger to position in a correct posture with a circular shape being formed by the portion between the thumb and the index finger. Hence, the wrist can be relaxed, and the hand can hold the pen correctly in writing.

In a fourth aspect of the invention, the pen having a convex device for index finger exerting force thereon can enable an individual to hold the pen correctly in writing a longitudinal word. Hence, an increased movement range of the hand can be obtained in a labor saving manner in writing.

In a fifth aspect of the invention of the pen having a convex device for index finger exerting force thereon, the index finger is bent to form a circle at the portion between the thumb and the index finger. Hence, the pen can be held firmly, both the thumb and the index finger are prevented from being too close to the tip of the pen, and a correct pen holding posture is obtained. Further, an individual may easily exert force on the raised convex device so that a great range of movement of the index finger can be achieved. Also, a great force can be exerted by the index finger. Further, both the thumb and the index finger are prevented from very firmly holding the pen in writing. Elevation of the index finger is slightly lower than that of the thumb so that the index finger may dispose in a substantially upright position to exert force.

In a sixth aspect of the invention, the middle finger is urged against one indentation, and the index finger is urged against the convex device. Thus, the index finger may be bent to cause the portion between the thumb and the index finger to form a circle in writing. More force is thus exerted by the index finger, since the convex device is arcuate in a labor saving manner. Further, the index finger is not strongly urged by the thumb. Furthermore, the pen is not held by both the thumb and the index finger. All of which are unnatural postures. Therefore, the drawbacks of inclined eyes, inclined body, inclined head, and muscle soreness in writing are eliminated by the invention.

The above and other objects, features and advantages of the invention will become apparent from the following detailed description taken with the accompanying drawings.

DETAILED DESCRIPTION OF THE INVENTION

Figure 1:
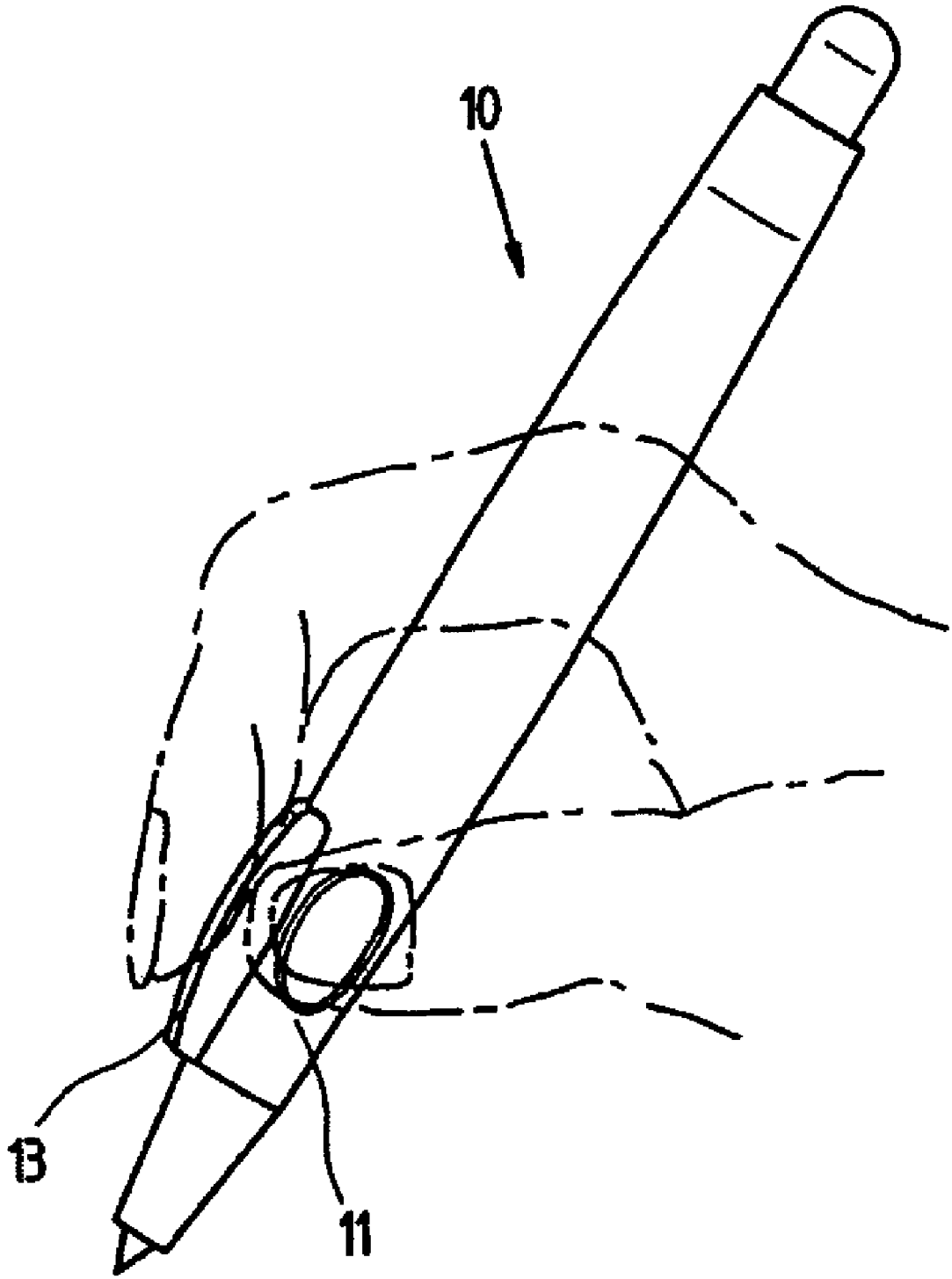
FIG. 1 is a perspective view of a first preferred embodiment of an ergonomic pen according to the invention being held by the hand.
Figure 2:
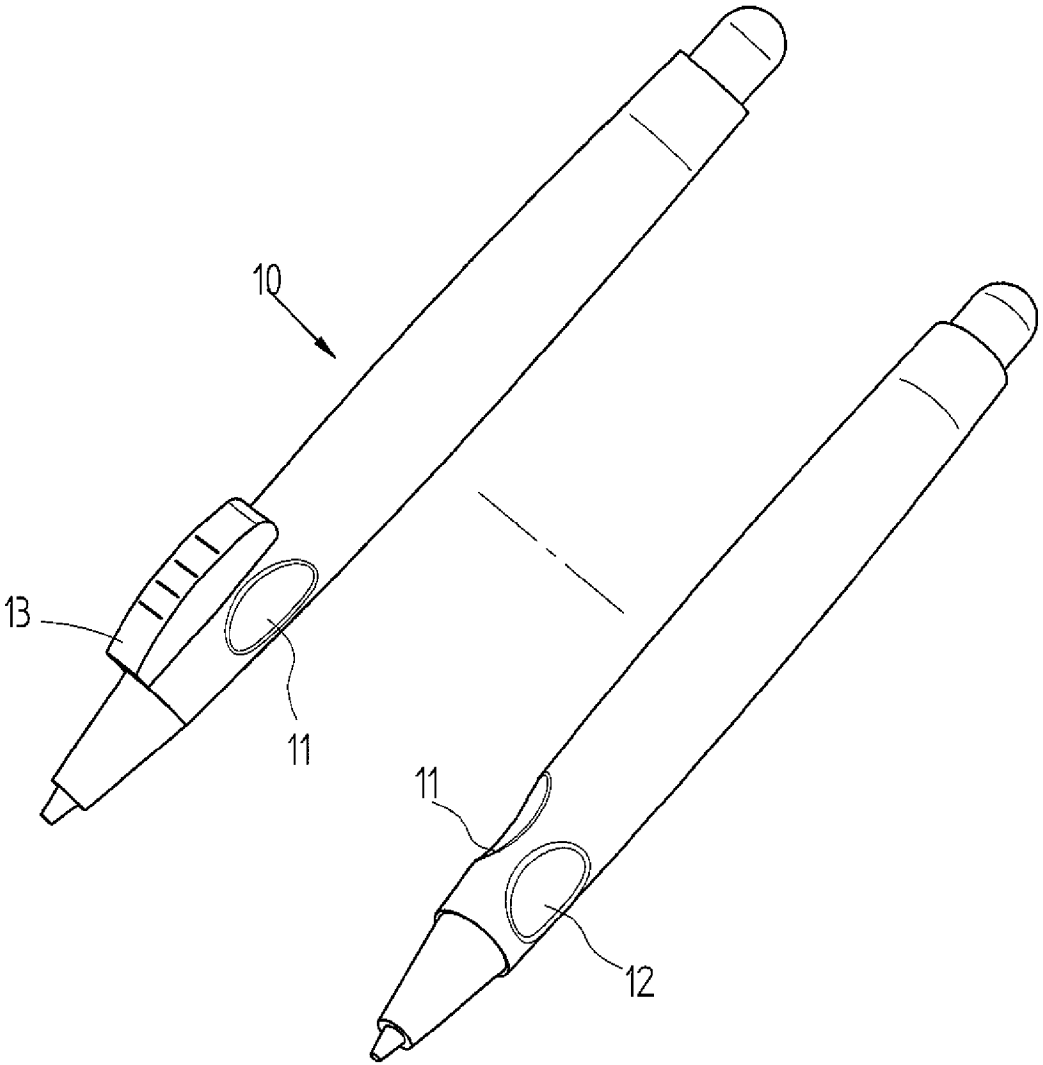
FIG. 2 is a perspective view showing positions of the ergonomic pen of FIG. 1 adapted to be held by the thumb, the index finger, and the middle finger respectively.
Figure 3:
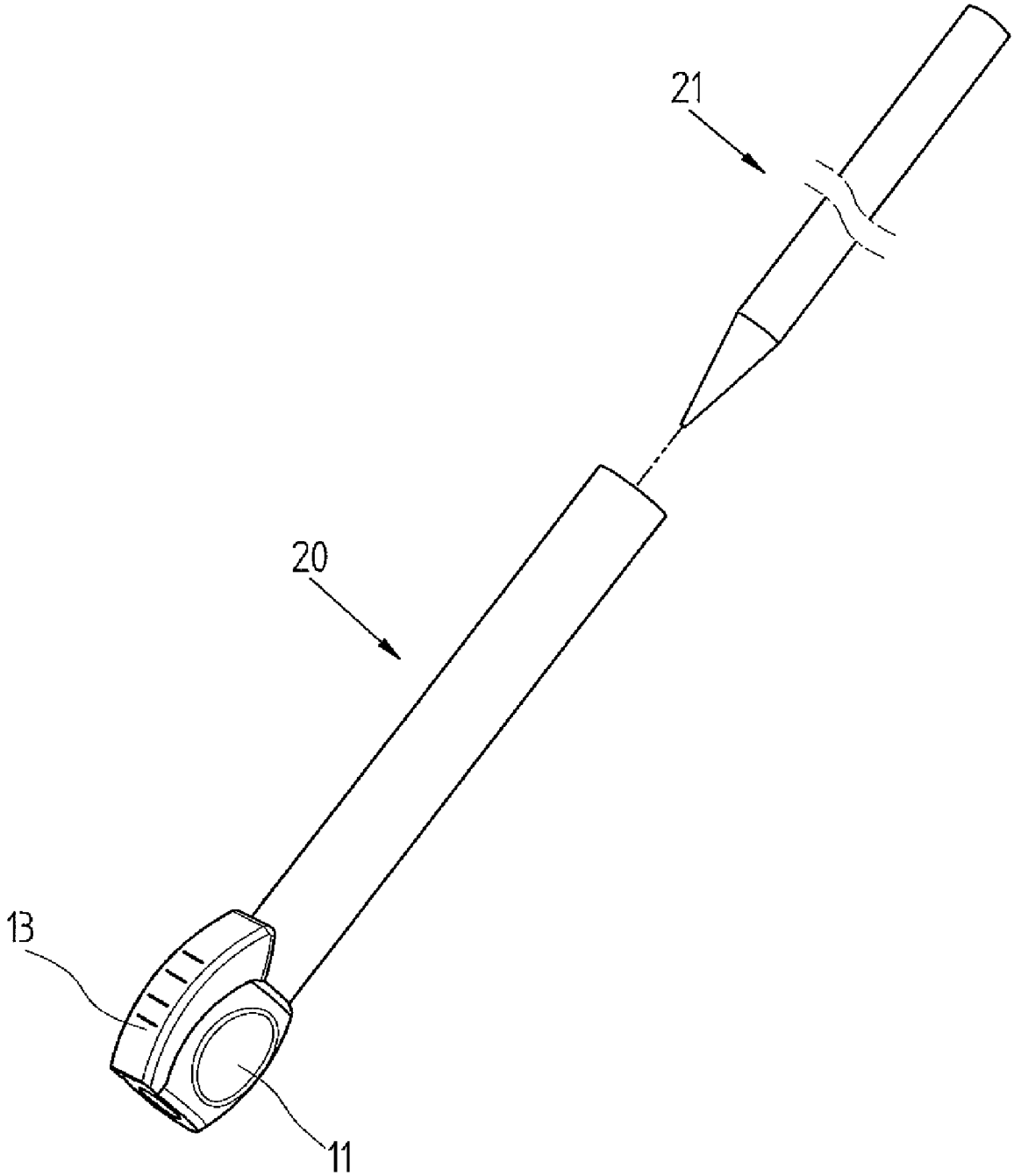
FIG. 3 is an exploded perspective view of a second preferred embodiment of an ergonomic pen according to the invention.
Figure 4:
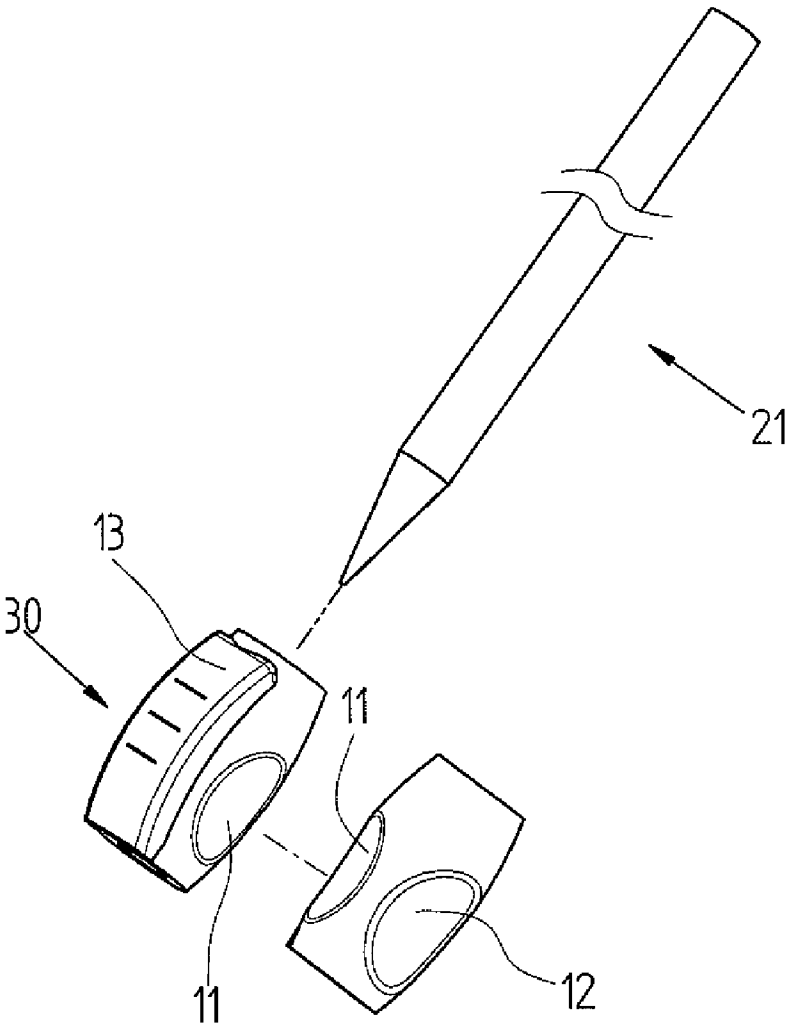
FIG. 4 is an exploded perspective view of a third preferred embodiment of an ergonomic pen according to the invention.
Figure 5A:
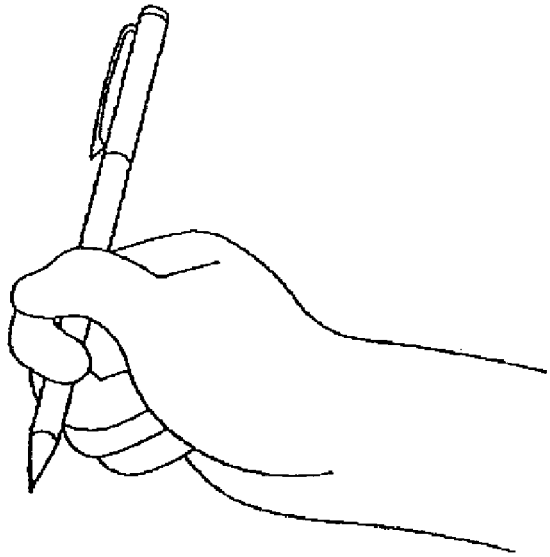
FIG.5A PRIOR ART
FIG. 5A is a perspective view of a conventional pen being held by the hand in one posture.
Figure 5B:
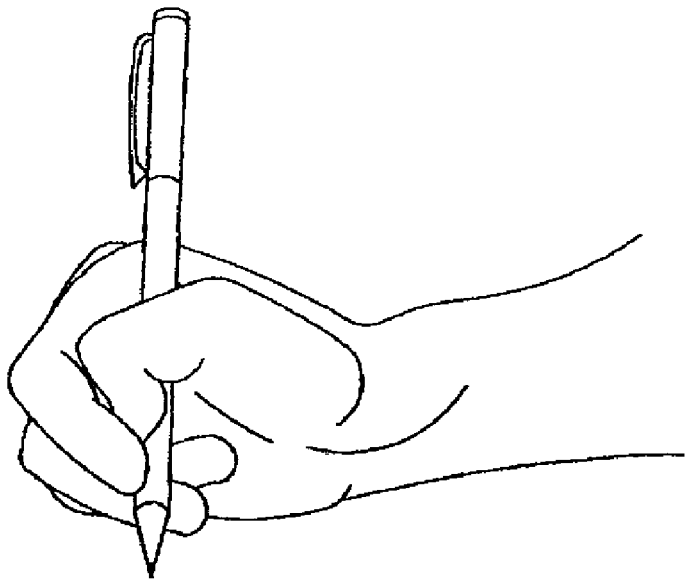
FIG.5B PRIOR ART
FIG. 5B is a view similar to FIG. 5A showing another posture.

Referring to FIGS. 1 and 2, an ergonomic pen having a convex device for an index finger exerting force thereon in accordance with a first preferred embodiment of the invention is generally designated by numeral 10. The pen 10 comprises the following components. A first indentation 11 is proximate one open end, a second indentation 12 is besides the first indentation 11, and a convex member 13 is opposite the second indentation 12. Preferably, the convex member 13 is elongate and has a visible depth and a knurled, arcuate top surface As shown in FIGS. 2-4, the elongated member includes first and second spaced sides extending in the longitudinal direction with the convex top surface extending between the first and second spaced sides and with the elongate member having cross-sections that are parallel to the elongate direction and are of a constant outer size and shape between the first and second spaced sides. The muscles opposing the finger nails of the thumb, the middle finger, and the index finger are urged against the first indentation 11, the second indentation 12, and the knurled portion of the convex member 13 respectively with the wrist being disposed in a relatively relaxed position in writing. This writing posture has the following advantages and characteristics. The view is not blocked by the fingers and hence an individual may not have to incline the head in writing. The index finger is bent substantially as a U. The thumb and the index finger are disengaged from each other. The thumb, the index finger, and the middle finger all are disposed in a position relatively distal the tip of the pen. The portion between the thumb and the index finger is substantially shaped as a circle. The first indentation 11, the second indentation 12, and the convex member 13 are firmly gripped by the thumb, the middle finger, and the index finger respectively. The index finger is adapted to exert a great force upon the convex member 13 but in a labor saving manner. The thumb is substantially at a higher elevation as compared with the index finger. It is hence contemplated by the invention that an individual may feel a degree of comfort in writing.

Referring to FIG. 3, an ergonomic writing instrument having a convex device for an index finger exerting force thereon in accordance with a second preferred embodiment of the invention is shown. An elongate sleeve 20 has a first indentation 11 proximate one open end, a second indentation (not shown) opposite the first indentation 11, and a convex member 13 between the first indentation 11 and the second indentation. Preferably, the convex member 13 is elongate and has a visible depth and a knurled, arcuate top surface. A cylindrical writing element such as either a pencil 21 or a pen has a tip (not numbered) and is secured to the sleeve 20 by inserting through. The advantages of the second preferred embodiment are detailed below. The view is not blocked by the fingers and hence an individual may not have to incline the head in writing. The index finger is bent substantially as a U. The thumb and the index finger are disengaged from each other. The thumb, the index finger, and the middle finger all are disposed in a position relatively distal the tip of the pen. The portion between the thumb and the index finger is substantially shaped as a circle. The first indentation 11, the second indentation, and the convex member 13 are firmly gripped by the thumb, the middle finger, and the index finger respectively. The index finger is adapted to exert a great force upon the convex member 13 but in a labor saving manner. The thumb is substantially at a higher elevation as compared with the index finger. It is hence contemplated by the invention that an individual may feel a degree of comfort in writing.

Referring to FIG. 4, an ergonomic pen having a convex device for an index finger exerting force thereon in accordance with a third preferred embodiment of the invention is shown. The characteristics of the third preferred embodiment are detailed below. The elongate sleeve 20 is replaced by a short sleeve 30. The sleeve 30 comprises a first indentation 11 proximate one open end, a second indentation 12 besides the first indentation 11, and a convex member 13 between the first indentation 11 and the second indentation 12. The convex member 13 has a length slightly shorter than that of the sleeve 30. The cylindrical pencil 21 is secured to the sleeve 30 by inserting through.

The advantages of the third preferred embodiment are detailed below. The view is not blocked by the fingers and hence an individual may not have to incline the head in writing. As shown in FIGS. 1 and 2, the index finger is bent substantially as a U. The thumb and the index finger are disengaged from each other. The thumb, the index finger, and the middle finger all are disposed in a position relatively distal the tip of the pen. The portion between the thumb and the index finger is substantially shaped as a circle. The first indentation 11, the second indentation 12, and the convex member 13 are firmly gripped by the thumb, the middle finger, and the index finger respectively.

The index finger is adapted to exert a great force upon the convex member 13 but in a labor saving manner. The thumb is substantially at a higher elevation as compared with the index finger. It is hence contemplated by the invention that an individual may feel a degree of comfort in writing.

In short, the invention has the following advantages.

The view is not blocked by the fingers and hence an individual may not have to incline the head in writing. The index finger is bent substantially as a U. The thumb and the index finger are disengaged from each other. The thumb, the index finger, and the middle finger all are disposed in a position relatively distal the tip of the pen.

Moreover, the portion between the thumb and the index finger is substantially shaped as a circle. The first indentation, the second indentation, and the convex member are firmly gripped by the thumb, the middle finger, and the index finger respectively. The index finger is adapted to exert a great force upon the convex member but in a labor saving manner. The thumb is substantially at a higher elevation as compared with the index finger. It is hence contemplated by the invention that an individual may feel a degree of comfort in writing.

While the invention herein disclosed has been described by means of specific embodiments, numerous modifications and variations could be made thereto by those skilled in the art without departing from the scope and spirit of the invention set forth in the claims.

What is claimed is:

1. An ergonomic writing instrument comprising:

a writing element having a tip and an opposite end spaced in a longitudinal direction from the tip;

a first indentation proximate the tip and having a longitudinal span along the longitudinal direction;

a second indentation beside but circumferentially spaced from the first indentation, with said second indentation having an longitudinal span along the longitudinal direction, with the longitudinal spans of the first and second indentations overlapping along the longitudinal direction; and an elongate member circumferentially between the first indentation and the second indentation, with the elongate member having a convex top surface, with the convex top surface having a longitudinal span of a convex shape in the longitudinal direction at least equal to the longitudinal spans of both of the first and second indentations, and wherein the elongate member includes first and second spaced sides extending in the longitudinal direction with the convex top surface extending between the first and second spaced sides, with the elongate member having cross sections parallel to the longitudinal direction of a constant outer size and shape between the first and second spaced sides, wherein the first indentation is adapted to be urged by the muscle opposing the finger nail of the thumb, the second indentation is adapted to be urged by the muscle opposing the finger nail of the middle finger, and the elongate member is adapted to be urged by the muscle opposing the finger nail of the index finger respectively in writing.

2. The ergonomic writing instrument of claim 1, further comprising a sleeve including the first indentation, the second indentation, and the elongate member; with the writing element secured to the sleeve by inserting therethrough.

3. The ergonomic writing instrument of claim 2, wherein the sleeve is shorter than the writing element.

4. The ergonomic writing instrument of claim 1 wherein the first indentation has a first spacing in the longitudinal direction from the tip; and wherein the second indentation has a second spacing in the longitudinal direction from the tip, with the second spacing being less than the first spacing.

5. The ergonomic writing instrument of claim 4 with the convex top surface extending in the longitudinal direction closer to the tip than the second indentation.

* * * * *